US006668435B2

(12) United States Patent
Wood et al.

(10) Patent No.: US 6,668,435 B2
(45) Date of Patent: Dec. 30, 2003

(54) LOOP PILE FABRICS AND METHODS FOR MAKING SAME

(75) Inventors: Maynard Wood, Gaffney, SC (US); Heather Jean Hayes, Chesnee, SC (US); Michael Paul Sasser, Cowpens, SC (US); Brian G. Morin, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 401 days.

(21) Appl. No.: 09/756,969

(22) Filed: Jan. 9, 2001

(65) Prior Publication Data

US 2002/0124365 A1 Sep. 12, 2002

(51) Int. Cl.[7] ..... D06C 11/00
(52) U.S. Cl. ..... 28/162; 28/160; 26/2 R
(58) Field of Search ..... 28/162, 160, 167, 28/104, 159, 163; 26/2 R, 29 R, 30, 69 R; 66/194; 112/410, 411; 428/85, 91, 96

(56) References Cited

U.S. PATENT DOCUMENTS

| | | | | | |
|---|---|---|---|---|---|
| 2,241,222 | A | * | 5/1941 | Sonnino | 26/2 R |
| 2,430,425 | A | * | 11/1947 | Jackson | 28/159 |
| 3,024,518 | A | * | 3/1962 | Newton | 28/159 |
| 3,357,075 | A | * | 12/1967 | Law | 28/160 |
| 3,431,875 | A | * | 3/1969 | Boultinghouse | 28/162 |
| 3,520,762 | A | * | 7/1970 | Sakamoto et al. | 28/162 |
| 3,672,929 | A | | 6/1972 | Riordan | 117/25 |
| 3,707,746 | A | | 1/1973 | Summers | 27/72.2 |
| 3,751,777 | A | * | 8/1973 | Turmel et al. | 28/159 |
| 4,147,575 | A | | 4/1979 | Hurtes | 156/72 |
| 4,233,349 | A | | 11/1980 | Niederhauser | 428/92 |
| 4,499,637 | A | * | 2/1985 | Greenway | 26/2 R |
| 4,741,075 | A | | 5/1988 | Taguchi et al. | 28/104 |
| 4,743,483 | A | * | 5/1988 | Shimizu et al. | 26/2 R |
| 4,967,456 | A | | 11/1990 | Sternlieb et al. | |
| 4,995,151 | A | | 2/1991 | Siegel et al. | |
| 5,080,952 | A | | 1/1992 | Willbanks | |
| 5,136,761 | A | | 8/1992 | Sternlieb et al. | |
| 5,148,583 | A | * | 9/1992 | Greenway | 26/2 R |
| 5,292,573 | A | | 3/1994 | Adams, Jr. et al. | 428/196 |
| 5,295,997 | A | | 3/1994 | Vuillaume et al. | |
| 5,393,304 | A | | 2/1995 | Vuillaume et al. | |
| 5,396,689 | A | | 3/1995 | Vuillaume | |
| 5,566,433 | A | * | 10/1996 | Love, III et al. | 26/2 R |
| 5,632,072 | A | | 5/1997 | Simon et al. | |
| 5,657,520 | A | | 8/1997 | Greenway et al. | |
| 5,718,022 | A | | 2/1998 | Vuillaume | |
| 5,727,292 | A | | 3/1998 | Vuillaume | |
| 5,737,813 | A | | 4/1998 | Sternlieb et al. | |
| 5,768,756 | A | | 6/1998 | Noelle | |
| 5,791,164 | A | | 8/1998 | Carroll et al. | |
| 5,806,155 | A | | 9/1998 | Malaney et al. | |
| 5,870,807 | A | | 2/1999 | Beaty et al. | |
| 5,933,931 | A | | 8/1999 | Greenway | |
| 5,943,745 | A | | 8/1999 | Dischler | |
| 5,983,469 | A | | 11/1999 | Beaty et al. | |
| 6,087,279 | A | | 7/2000 | Laun | |

* cited by examiner

*Primary Examiner*—A. Vanatta
(74) *Attorney, Agent, or Firm*—Terry T. Moyer; Jeffrey E. Bacon

(57) ABSTRACT

A lightweight loop pile fabric having improved particle pick-up is described. In addition, a patterned loop pile fabric is described. The fabric has a plurality of multifilament loops extending from at least one of its surfaces, with at least some of the loops being teased. In one embodiment, the loops are formed from splittable multifilament yarns which are hyper-split during the manufacturing process to form teased loops. The fabrics perform particularly well in the manufacture of wiping cloths with enhanced performance characteristics. In addition, the fabrics enable the production of patterned articles having performance characteristics similar to or exceeding those of unpatterned goods. A process for making the fabrics is also described.

10 Claims, 3 Drawing Sheets

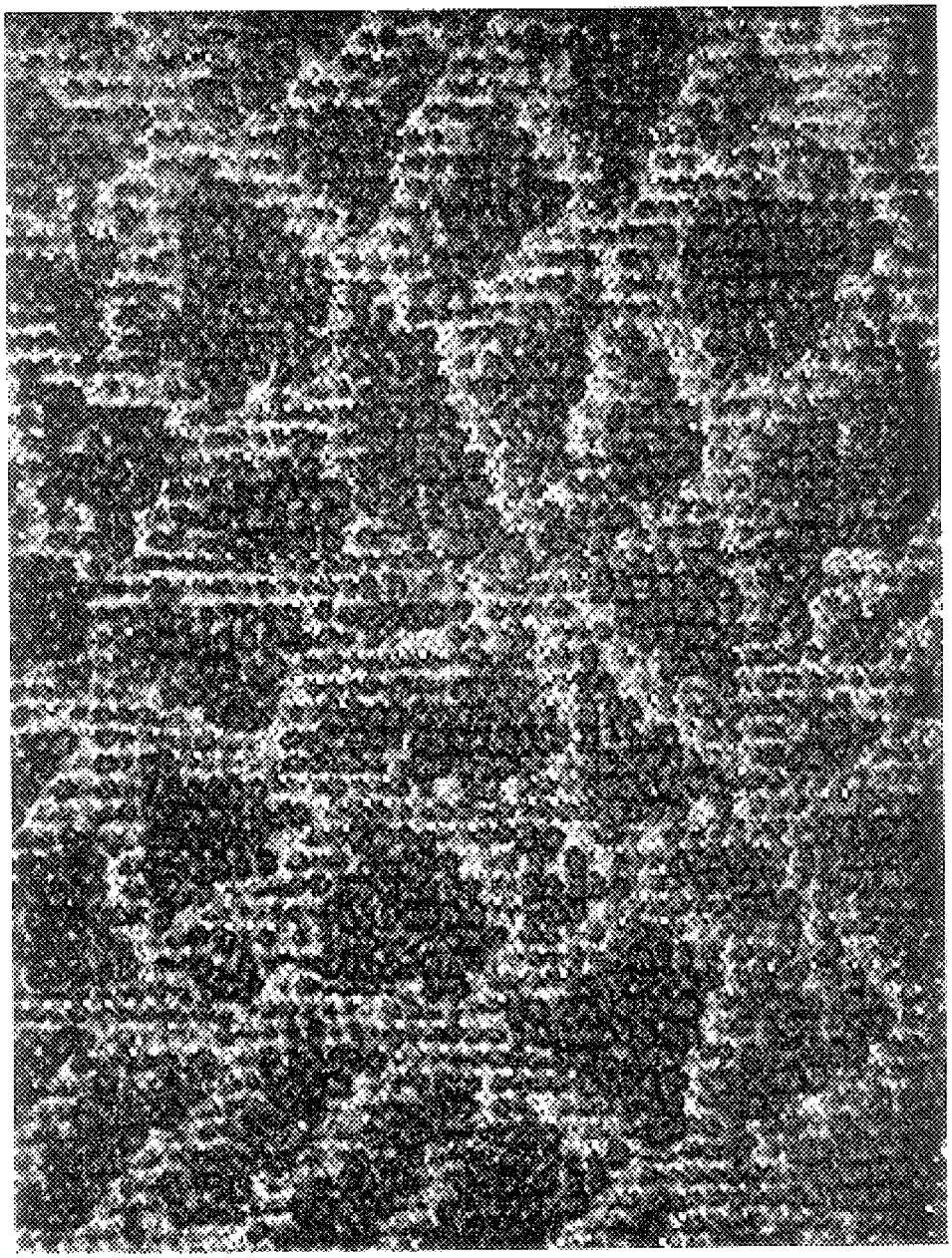
FIG. —5—

LOOP PILE FABRICS AND METHODS FOR MAKING SAME

BACKGROUND

Loop pile fabrics are used in a variety of end uses, including but not limited to such things as cleaning products, hook and loop fasteners, carpets, and the like. Among other things, such fabrics are valued for their softness, ability to pick up particles, moisture absorption, and the like.

For example, loop pile fabrics have been found to perform well in the manufacture of wiping cloths of the variety used in residential and commercial cleaning. These wiping cloths are generally circularly knit and have an integrally knit, short loop pile (i.e. on the order of 1 mm) of fine denier yarns. The pile is formed from splittable yarns of nylon and polyester, which separate during processing of the fabric to produce a pile which has good moisture absorption and small particle pick up.

Another type of commercially available wiping cloth is made from a warp knit fabric having an integrally formed pile of relatively longer pile loops (i.e. on the order of 2 mm long) formed from splittable fibers. While providing good large and small particle pick up, these cloths have several disadvantages. For one, the long microdenier fiber loops have a tendency to pick up oils from the user's skin, often leading to complaints of hand dryness. In addition, the long loops have a tendency to snag on a user's skin, leading to significant user discomfort and an overall negative aesthetic impact.

One disadvantage associated with prior loop pile fabrics is that they are limited in their aesthetic characteristics, particularly where it is important to have consistent performance characteristics across the dimension of the fabric. Heretofore, methods for patterning loop pile fabrics have been limited to printing a pattern on the fabric surface or forming the fabric using a jacquard weave or knit process. Where printing is used, it is difficult to achieve a consistent or defined pattern, due to the nature of the looped fabric surface. In addition, the printed substance can tend to interfere with the performance characteristics of the fabric. While jacquard weaving and knitting can provide fabrics having integrally formed patterns as a result of variations in loop height and/or color, they are generally less efficient, and therefore more expensive, to produce. Also, where variations in loop height are used to achieve the pattern, fabric performance can be affected.

SUMMARY

The present invention achieves enhanced particle pick-up relative to the above-described prior short loop product, without the negative aesthetic characteristics of the longer loop pile product described above. In addition, the process of the instant invention enables the production of patterned loop pile fabrics while avoiding the disadvantages associated with other patterning methods of loop fabrics. Furthermore, the fabrics of the invention achieve performance characteristics comparable or superior to prior fabrics. For example, the fabrics of the invention have comparable performance characteristics to those of thicker pile loop fabrics with superior wear properties and superior performance per unit thickness.

To this end, the fabric of the invention has a loop pile including a plurality of teased fiber loops on at least one of the fabric surfaces. It has been found that this unique surface provides greater absorbance and small and large particle pick-up per given fabric thickness than similar prior pile loop fabrics.

The process involves treating at least one surface of a fabric having fiber loops on at least one of its surfaces with a flow of high pressure fluid, to tease the fibers forming at least some of the fiber loops. The fluid treatment can be any type of fluid treatment including liquid or air treatment, but preferably comprises a hydraulic process of the variety conventionally used on flat woven fabrics.

As noted, the fabric can have loops on one or both fabric surfaces. Similarly, fluid treatment can be performed on one or both fabric surfaces.

The fluid treatment can be performed over the entire fabric, or it can be performed in a pattern, to thereby form a pattern in the fabric. Where both sides of the fabric are treated, they can have the same treatment pattern or different treatment patterns to create a unique visual effect.

BRIEF DESCRIPTION OF THE DRAWINGS

FIG. 5 is a photograph (2×magnification) of an alternative embodiment of the invention, illustrating a patterned embodiment which has been subjected to the Small Particle Test described below, with the darkened regions illustrating where the ferric oxide has been picked up in quantity.

DETAILED DESCRIPTION

In the following detailed description of the invention, specific preferred embodiments of the invention are described to enable a full and complete understanding of the invention. It will be recognized that it is not intended to limit the invention to a particular preferred embodiment described, and although specific terms are employed in describing the invention, such terms are used in a descriptive sense for the purpose of illustration and not for the purposes of limitation.

Figure 1:
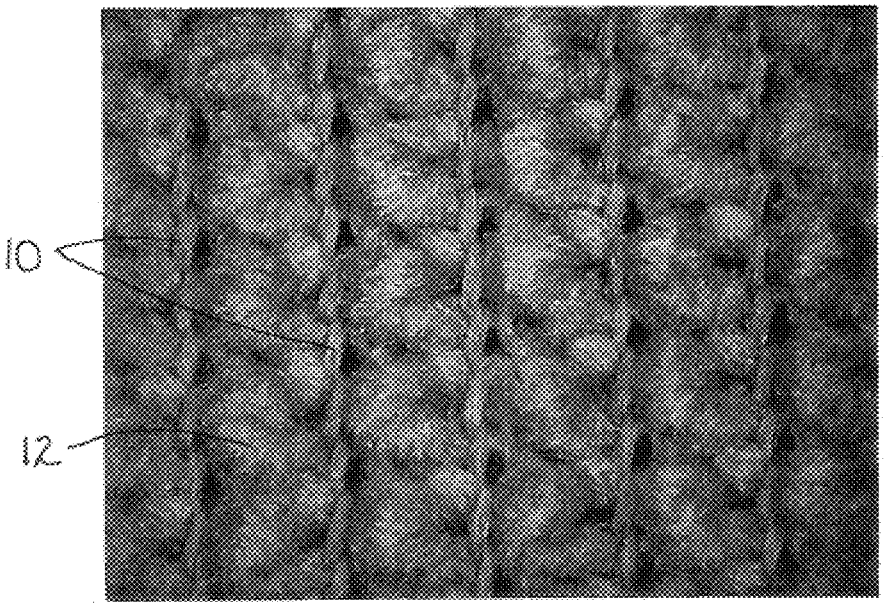
FIG. 1 is a photograph (12×magnification) of the Sample A fabric.
Figure 3:
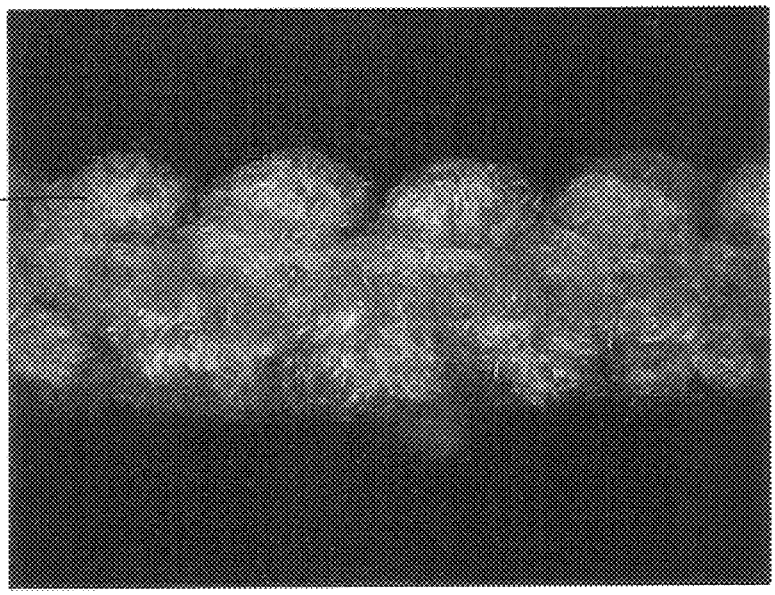
FIG. 3 is a photograph (16.8×magnification) of a cross-section view of the Sample A fabric.

With reference to the drawings, FIG. 1 is an enlarged photograph of a conventional commercially available loop pile fabric of the variety used in the manufacture of wiping cloths. FIG. 3 is an enlarged view of a cross-section of that same fabric. The base fabric 10 is clearly visible between the pile loops 12.

Figure 2:
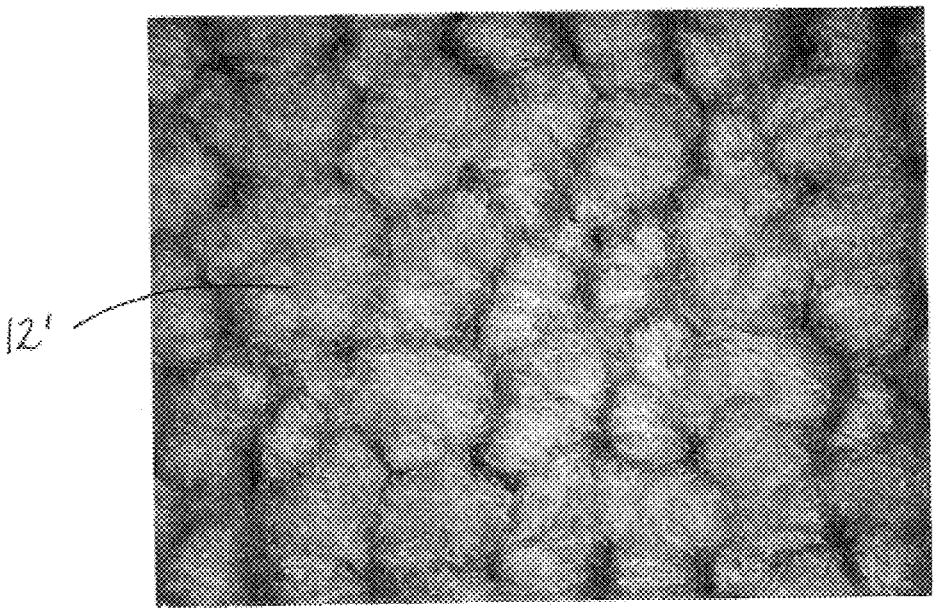
FIG. 2 is a photograph (12×magnification) of the Sample D fabric, which has substantially 100% of its pile loops teased according to the invention.
Figure 4:
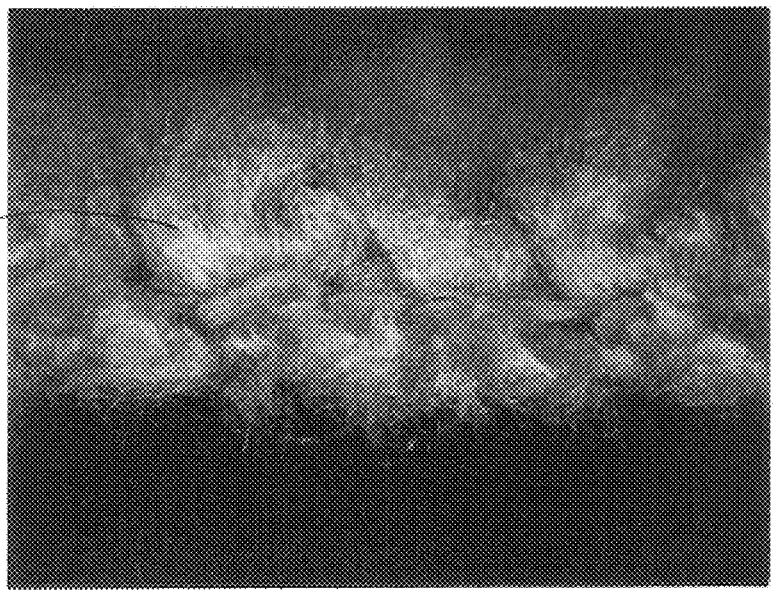
FIG. 4 is a photograph (16.8×magnification) of a cross-section of the Sample D fabric.

FIGS. 2 and 4 are enlarged photographs of the FIG. 1 fabric after it was subjected to the process according to the present invention. As is readily apparent from the figures, the loops 12' are in a teased form, with the base fabric surrounding the loops no longer being visible.

The process involves providing a fabric having a pile including multifilament loops extending from at least one fabric surface. Preferably, the loops have a height of less than about 2 mm, more preferably less than about 1.7 mm, and more preferably less than about 1.3 mm. (For purposes of this application, loop height was determined by folding the loop pile fabric to be measured over an edge, then taking an enlarged photograph of a ruler beside the loop pile. From this photograph, the height of the loop when it is in its relaxed state could be readily determined.) In some aspects of the invention, loops are provided on both the front and back surfaces of the fabric. In a preferred form of the invention, substantially all of the pile is formed from multifilament fiber loops. However, some of the loops can be made from other than multifilament yarns if desired.

In one aspect of the invention, the multifilament loops include microdenier fibers. For example, the loops can be knit with microdenier fibers in the loops, or they can include splittable fibers which separate into smaller fibers upon chemical or mechanical processing. In a preferred form of the invention, the pile loops are formed from commercially-available splittable polyester/nylon fibers. In a particularly preferred form of the invention, the pile loops are made substantially entirely from splittable polyester/nylon fibers which can be split into a plurality of microdenier fibers after fabric formation. Where splittable fibers are used, they can be split in any manner (e.g. mechanical, chemical, or the like) or they can be of the variety where a portion of the fiber is dissolved away to leave a plurality of smaller filaments (i.e. an island-in-the-sea variety.) The splittable fibers can be split into finer denier filaments of any shape, including but not limited to pie-shaped, ribbon-shaped, irregularly-shaped, round or the like. Preferably the fibers are split to form filaments of less than 0.5 dpf average size. Particularly preferred are filaments about 0.01–5 dpf in size, and more preferably about 0.1 to less than about 1.0 dpf.

The loops can be provided in any desired concentration, but are desirably provided in a concentration of about 9 to 400 loops per sq cm, and more preferably about 25–100 per sq cm, and even more preferably about 50–75 per sq cm. As will be appreciated, the number of loops per dimension of fabric will depend on the characteristics desired for the end product as well as the size of the yarns used to form the loops. For example, it has been found to be desirable to use yarns having a denier of about 30–1000 denier, and more preferably about 60–500 denier, to form the loops. Within these loops, it is desirable to have from about 100–10,000 individual filaments, and more preferably about 250–2500 filaments. Again, the number of filaments used will depend on the size and shape of the filaments as well as the performance and aesthetic characteristics desired for the fabric.

The base fabric can be made in any desired manner including but not limited to knitting, weaving, nonwoven manufacturing processes or the like. In a preferred form of the invention, the base fabric is knit by a circular knitting process, with the pile loops being integrally formed during the knitting process. However, other processes for forming the base fabric and/or the loops could also be used within the scope of the invention. The base will be selected to provide the requisite strength, weight, and performance characteristics desired, and is preferably selected to provide good support for the pile loops, such that they are not undesirably blown out of the fabric during the fluid treatment process. Preferably the fabric has a thickness at 0.5 g/cm$^2$ of less than about 4 mm, more preferably less than about 3.5 mm, and more preferably less than about 3 mm. However, the thickness will vary depending on such factors as base fabric thickness, loop height, and whether the loops are located on one or both sides of the fabric. In addition, the fabrics are desirably relatively lightweight, desirably having basis weight of about 2–100 mg/cm$^2$, more preferably about 5–60 mg/cm$^2$, and even more preferably about 10 to about 40 mg/cm$^2$.

The fabric can be dyed if desired to achieve an overall color. In some forms of the invention where splittable fibers are used to form at least some of the pile loops, the dye process will serve to split the splittable fibers into smaller fibers. However, other conventional means for splitting the filaments could also be used within the scope of the invention, as can other methods for coloring the yarns and/or fabric. At this point, the fabric will have a plurality of unteased multifilament loops, with these loops being characterized by the filaments being substantially parallel to each other within the loop.

The fabric having the loop pile is then caused to be impinged by a flow of high pressure fluid, which functions to tease at least some of the fiber loops. By virtue of this teasing operation, the previously parallel fibers within the teased loops are splayed apart and become non-parallel so that the loops become expanded and bulky. However, the filaments are still intact rather than broken. While fluid processing has been described as being the preferred method of fiber loop teasing, other methods to form teased fiber loops can be used within the scope of the invention.

Any type of available fluid treatment process which can be operated at levels sufficient to tease the pile loops can be used. However, in a preferred aspect of the invention, the treatment process is a hydraulic treatment process. For example, the process described in commonly-assigned U.S. patent application Ser. No. 09/344,596 for "Napped Fabric and Process" has been found to perform well in the invention. That application, filed Jun. 25, 1999 by Emery et al, is incorporated herein by reference. In that process, a high pressure fluid is directed as a plurality of discrete parallel streams onto the surface of the moving fabric to be treated. As the fabric moves along a path that takes it into the region immediately adjacent to the stream, it comes into contact with a support member which is preferably in the form of a steel roll.

The fluid streams are desirably directed at an angle that is slightly non-perpendicular to the support roll, for example, at an angle of between about 1 degree and 10 degrees. In a preferred form of the invention, the fluid is directed at an angle of impingement of about 1–3 degrees, and more preferably about 2 degrees.

In some aspects of the invention, the fluid treatment is provided on a single side of the fabric. In the case of fabrics having the loop pile on a single fabric surface, the fluid treatment is preferably performed on the side opposite the loop pile surface of the fabric. However, the treatment could also be performed only on the loop pile surface of the fabric, or on both surfaces of the fabric, within the scope of the invention. Where the fabric being treated has loops on each of its surfaces, treatment can be performed on one or both fabric surfaces within the scope of the invention. Where treatment is performed on both surfaces of the fabric, it can be performed by running the fabric through the apparatus twice, or by using a process designed to process both surfaces of the fabric in a single pass of the fabric. For example, the apparatus can impinge the front surface of the fabric with a first flow of fluid and then immediately thereafter impinge the fabric back surface with a second flow of fluid. It has been found that where fluid treatments are applied to both the front and back surfaces of the fabric, it is desirable to use treatment pressures on the second side which are less than those applied to the first side, and preferably on the order of about two-thirds of the first side pressure.

While the specific treatment process described has been described for purposes of illustration, it is noted that other fluid processing techniques can be used within the scope of the invention.

Fabric Construction & Examples:

Sample A was a 85/15 PET/nylon circular knit fabric having integrally formed loops about 1 mm in height on both the front and back fabric surfaces. The loops were in a concentration of about 49 loops per sq cm on each surface. The fabric had a basis weight of 25 mg/cm$^2$, and a thickness of 2.21 mm at 0.5 gf/cm$^2$. The base fabric was double knit from a 150 denier/34 filament textured PET filament, and the loops were formed from 2-ply 150/48 splittable 70/30 PET/nylon splittable yarns which were split to form 1056 filaments 0.1–0.4 dpf in size with an average dpf of 0.28 in each loop. These splittable yarns are tucked into the base knit construction and knitted into loops through a sacrificial water-soluble poly(vinyl alcohol) yarn in a manner which will be readily appreciated by those of ordinary skill in the art. The water-soluble yarns were dissolved in a hot water scour to free the loops. The fabric was dyed using a conventional jet dye process, then dried and heatset in a conventional manner.

Sample B was produced by further processing a piece of the Sample A fabric. In particular, the fabric was fed through a hydraulic enhancement machine of the variety described above in commonly-assigned U.S. patent application Ser. No. 09/344,596 (described above), and at a speed of 10 yards per minute (ypm) with a 0.13" gap, and hydraulically processed with 1200 psi of water pressure at a 2-degree angle of impingement. Although the fabric had loops on each of its surfaces, it was treated only on one side. The fabric was supported on a solid roll, and the fluid was sprayed through a screen which had a pattern of openings resulting in approximately 25% of the fabric surface being treated.

Sample C was produced in the same manner as Sample B, using a screen having a different pattern of openings designed to provide treatment of approximately 60% of the fabric surface. Again, the treatment was performed on only one side of the fabric.

Sample D was produced in the same manner as Sample B, without a patterned screen so as to provide full surface treatment (100%) of the fabric. The fabric was treated on both sides, with the treatment on the back side of the fabric being about two-thirds of the pressure applied to the front side (i.e. about 800 psi.)

Sample E was a commercially available terry wiping cloth of the variety sold by Solutions of Portland, Oreg. under the tradename Miracle Cloth™. The wiping cloth was made from a warp knit fabric having an integrally formed pile of relatively longer (i.e. on the order of 2 mm long) pile loops formed from splittable fibers on both of its surfaces. The loops were in a concentration of approximately 51 loops per sq cm on each surface. The loops in the commercial product are unteased, although the splittable fibers had been split.

Tests

Thickness Test: Thickness measurements were obtained using ASTM D-1777-96 using a compression test apparatus with a 2 sq cm foot, and 0.5 gf/cm$^2$, 2.5 gf/cm$^2$, and 6 gf/cm$^2$ as indicated.

Basis Weight: 20 cm×20 cm samples were weighed and reported in mg/cm$^2$.

Absorbance Test: Water absorption values were obtained according to the Institute of Environmental Sciences and Technology (IEST) Contamination Control Division Recommended Practice 004.2, which is known as IEST-RP-CC004.2, Section 7.1, "Evaluating Wiping Materials Used in Cleanrooms and Other Controlled Environments."

Fabric Drag: Fabric drag was tested using the Sled Friction Test outlined in ASTM D-1894-93 on a glass substrate. The sled used was 4 inches square and weighed 200 g.

Large Particle Pick-up Test: The fabric to be tested using a Fabric Rubbing tester, which is available from Dr. Patricia A. Annis in the Department of Textile Sciences at the University of Georgia in Athens, Ga. The apparatus has a top plate to which a piece of fabric can be attached, and this top plate can be controlled to rub against a bottom plate using a predetermined amount of pressure and for a predetermined period of time. The top plate was 6" in diameter while the bottom plate was 14" in diameter. A 6" disc of the fabric to be tested was weighed to the nearest 0.001 g, and then attached to the 6" diameter flat, circular aluminum plate. 0.25 g of sand was spread evenly across a 18" diameter of plain weave fabric constructed from 42 ends×42 picks per centimeter of 630 denier/105 filament nylon yarns. The plain weave fabric was supported on the 14" diameter bottom plate. The sand was of the variety commercially available under the name Kelly's Craft and Activity Sand from Kelly's Crafts, Inc., variety #5730, distributed by Wal-Mart, Inc. The sand size was characterized by 94 weight % passing through a 600 $\mu$m mesh and 42 weight % passing through a 425 $\mu$m mesh. The apparatus moved the sample fabric across the sand-covered nylon fabric through 50 rotations with 75–95 grams of force applied, at a rate of approximately 35 cycles/minute. This process served to effect an equilibrium distribution of the particles between the two fabrics. The sample fabric was then weighed again and the initial weight subtracted to determine the amount of sand picked up by the sample fabric.

Small Particle Pick-up Test: The same test was performed as the Large Particle Test, only 0.250 g of ferric oxide (I-116 from Fisher Scientific Company of Hampton, N.H.) was spread evenly across the nylon fabric rather than sand and the fabric was cycled through 250 rotations at a rate of approximately 35 cycles/minute. The ferric oxide was characterized by a particle size between about 1 and 2 microns.

Thermal Conductivity: Thermal conductivity was tested using a Thermo-Labo II Tester-KES FB-7 from Kato Tech Co., Ltd. of Kyoto, Japan. The tests were performed according to the equipment manufacturer's directions of machine operation, using a 10 degree Celsius differential temperature (23.6 to 33.6 degrees) with a 6.0 gf/cm$^2$ device to measure the heat flow. The fabric size tested for each fabric was 25 sq cm. K=W*thickness/area*$\Delta$T.

Wear Properties: Wear properties were tested according to ASTM D4970-98 Test Method (pilling test). The fabric was graded at 500 and 7,000 cycles The thickness measurements, basis weights, absorbance, and drag are listed below in Table A. The particle pick-up, thermal conductivity, and pill rating are listed in Table B. These values were divided by the fabric thicknesses, and the results of these ratios are listed in Table C.

TABLE A

| | Thickness (mm) | | | Basis | Absorbance | Drag |
|---|---|---|---|---|---|---|
| | 0.5 gf/cm$^2$ | 2.5 gf/cm$^2$ | 6 gf/cm$^2$ | Wt mg/cm$^2$ | g $H_2O$/g fabric | (glass) COF |
| Sample A | 2.21 | 1.89 | 1.86 | 24.7 | 4.29 | 0.86 |
| Sample B | 2.17 | 1.71 | — | 27.3 | 4.17 | 0.594 |
| Sample C | 2.36 | 1.72 | — | 26.9 | 4.20 | 0.397 |
| Sample D | 2.41 | 1.92 | 1.879 | 26.4 | 5.75 | 0.381 |
| Sample E | 4.72 | 3.59 | 3.47 | 23.4 | 7.91 | 0.065 |

TABLE B

| | Particle Pick-up (g) | | | Pill Rating | |
|---|---|---|---|---|---|
| | Sand | Iron Oxide | Conductivity(k) (mW/cm-C.°) | 500 Cycles | 7,000 Cycles |
| Sample A | 0.004 | 0.09 | 0.626 | 4.5 | 4.0 |
| Sample B | 0.125 | 0.12 | — | — | — |
| Sample C | 0.15 | 0.11 | — | — | — |
| Sample D | 0.2 | 0.11 | 0.622 | 4.5 | 4.5 |
| Sample E | 0.23 | 0.16 | 0.638 | 2.0 | 2.0 |

TABLE C

| | Absorbance/ thickness (1/cm) | Drag (glass) COF/ thickness (1/cm) | Particle Pick-up (Sand)/ thickness (g/cm) | Particle Pick-up (Iron Oxide)/ thickness (g/cm) |
|---|---|---|---|---|
| Sample A | 1.94 | 0.39 | 0.002 | 0.04 |
| Sample B | 1.92 | 0.27 | 0.058 | 0.05 |
| Sample C | 1.78 | 0.17 | 0.064 | 0.05 |
| Sample D | 2.39 | 0.16 | 0.083 | 0.05 |
| Sample E | 1.68 | 0.014 | 0.049 | 0.03 |

The fabrics processed in a pattern had unique appearances, as evidenced by the sample illustrated in FIG. 5. In addition, it was surprisingly found that by teasing at least some of the fiber loops, a significant increase in particle pick-up, and in particular large particle pick-up, was achieved. For example, the fabrics desirably had a Large Particle Pick-up of at least 0.1 g, more preferably greater than 0.15 g, and even more preferably greater than 0.2 g. As illustrated, the large particle pick-up increased consistently with the greater quantity of fiber loops that were teased. As will be appreciated by those of ordinary skill in the art, the area of the fabric that is teased will depend on the aesthetic performance characteristics desired for the end product as well as the pattern to be formed, if any.

The fabrics also desirably have superior absorption as compared with prior products having similar loop height and thickness. Preferably, the absorbance is greater than about 4.3 g $H_2O$/g fabric, more preferably greater than about 4.6 g $H_2O$/g fabric, and even more preferably greater than about 5 g $H_2O$/g fabric.

In addition, examination of the fabric indicated that at least some of the fiber loops were pushed through the fabric by the fluid processing operation. Furthermore, as noted above, the loops were teased and bulked, rather than broken. Where the loops were formed from splittable fibers, the fluid processing served to hypersplit the fibers, thereby bulking and splaying the previously split fibers.

The fabric made according to the invention also had dramatically superior wear resistance as compared with the conventional longer-loop terry product, as evidenced by the dramatic difference in Pill Ratings. Preferably, the fabrics of the invention have pill ratings of greater than 2.0, more preferably about 3 or greater, and even more preferably about 4 or greater. This wear resistance preserves the aesthetic characteristics of the fabric.

Particularly of note was the fact that the fabrics had superior absorbency and particle pick-up as compared with fabric thickness. As noted previously, the disadvantages inherent in the thicker fabrics (i.e. those having a longer loop pile) included the tendency for them to snag on a user's skin and to wear poorly.

The fabrics of the invention can be used in virtually any end use where a loop pile fabric would have utility, including but not limited to cleaning products such as wiping cloths, upholstery fabrics, apparel fabrics, and the like.

In the specification there has been set forth a preferred embodiment of the invention, and although specific terms are employed, they are used in a generic and descriptive sense only and not for purposes of limitation, the scope of the invention being defined in the claims.

We claim:

1. A method for making loop pile fabrics comprising the steps of:

knitting a fabric having a plurality of multifilament loops integrally formed therein during the knitting process and extending outwardly from at least a first fabric surface; and impinging said first fabric surface with high pressure fluid, to thereby tease the filaments forming at least some of said multifilament loops.

2. The method according to claim 1, wherein said step of impinging is performed in a pattern, to thereby form a pattern of alternating teased and unteased loop regions.

3. The method according to claim 1, wherein said fabric has loops on both of its surfaces.

4. A method of making a patterned loop fabric comprising the steps of knitting a loop pile fabric having a plurality of multifilament loops integrally formed therein during the knitting process and extending outwardly from at least a first fabric surface, and impacting the loop pile fabric with at least one flow of fluid such that at least some of the loops of said fabric are teased.

5. The method according to claim 4, wherein said step of impacting the fabric with a flow of fluid is performed such that only a portion of the loops on the fabric are teased.

6. The method according to claim 5, wherein said step of impacting is performed so as to define a pattern of alternating regions of teased and unteased loops.

7. The method according to claim 4, wherein said loops are formed of splittable fibers, and said process of impacting the fabric functions to hypersplit the splittable fibers.

8. A method of making a fabric comprising the steps of:

knitting a fabric having a base and a plurality of spaced apart loops integrally formed therein during the knitting process and extending outwardly from at least one surface of said base such that said base is visible between neighboring loops when said fabric is in a relaxed state and subjecting said fabric to a fluid treatment process such that said loops are teased, to thereby cover portions of the base which were previously visible between the neighboring loops.

9. A method for making loop pile fabrics comprising the steps of:

providing a fabric having a plurality of multifilament loops extending outwardly from a first fabric surface and a second surface; and impinging said first fabric surface and said second fabric surface with high pressure fluid, to thereby tease the filaments forming at least some of said multifilament loops, wherein each of said fabric surfaces has a plurality of teased loops formed by the high pressure fluid.

10. A method of making a patterned loop fabric comprising the step of impacting a loop pile fabric with at least one flow of fluid such that at least some of the loop of said fabric are teased, wherein said step of impacting comprises forcing at least some of the fiber loops through the base fabric to the opposite surface thereof.

* * * * *